US008909081B2

(12) United States Patent
Hara et al.

(10) Patent No.: US 8,909,081 B2
(45) Date of Patent: Dec. 9, 2014

(54) IMAGE FORMING APPARATUS

(75) Inventors: Kazuyoshi Hara, Itami (JP); Hidetoshi Noguchi, Tahara (JP); Satoru Shibuya, Chiryu (JP); Takahiro Kuroda, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 47 days.

(21) Appl. No.: 13/486,183

(22) Filed: Jun. 1, 2012

(65) Prior Publication Data

US 2012/0308251 A1 Dec. 6, 2012

(30) Foreign Application Priority Data

Jun. 2, 2011 (JP) ..... 2011-124521

(51) Int. Cl.
*G03G 15/16* (2006.01)

(52) U.S. Cl.
CPC ..... *G03G 15/1605* (2013.01); *G03G 15/1675* (2013.01)
USPC ..... 399/66; 399/297; 399/314

(58) Field of Classification Search
USPC ..... 399/66, 114, 121, 297, 314
See application file for complete search history.

(56) References Cited

U.S. PATENT DOCUMENTS 5,291,253 A * 3/1994 Kumasaka et al. ..... 399/66
5,381,216 A * 1/1995 Osaka et al. ..... 399/315
5,633,703 A * 5/1997 Takenouchi et al. ..... 399/315
5,905,931 A * 5/1999 Shigeta et al. ..... 399/309
2003/0118359 A1* 6/2003 Ogiyama et al. ..... 399/45
2003/0123911 A1* 7/2003 Kayahara et al. ..... 399/297
2011/0044710 A1* 2/2011 Shida ..... 399/66

FOREIGN PATENT DOCUMENTS

JP 07-295407 11/1995
JP 08146777 A * 6/1996
JP 09-160402 6/1997
JP 10-198090 7/1998
JP 11-258930 9/1999
JP 2008-275946 A 11/2008
JP 2010-249872 A 11/2010

OTHER PUBLICATIONS

Notification of Reasons for Refusal issued in corresponding Japanese Patent Application No. 2011-124521, mailed Nov. 20, 2013, and English translation thereof.

* cited by examiner

*Primary Examiner* — Francis Gray
(74) *Attorney, Agent, or Firm* — Buchanan Ingersoll & Rooney PC

(57) ABSTRACT

An image forming apparatus having: a toner image carrier; a transfer member; a transfer voltage applying device which applies a bias voltage to the transfer member; a voltage controller which performs constant voltage control on the transfer voltage applying device; a transfer contribution current detecting device; an antistatic member for removing static electricity from the record medium after transfer of a toner image; and an antistatic voltage applying device which applies an AC voltage to the antistatic member. The transfer contribution current detecting device measures current values during a current detection time, which corresponds to an integral multiple of a period of the AC voltage applied to the antistatic member, and detects a transfer contribution current value from the measured values, and the voltage controller controls the bias voltage applied to the transfer member based on the transfer contribution current value.

4 Claims, 5 Drawing Sheets

IMAGE FORMING APPARATUS

This application is based on Japanese Patent Application No. 2011-124521 filed on Jun. 2, 2011, the content of which is incorporated herein by reference.

BACKGROUND OF THE INVENTION

1. Field of the Invention

The present invention relates to an image forming apparatus, and particularly relates to an image forming apparatus, such as a printer or a copier, which transfers a toner image onto a record medium such as paper by an electrophotographic method.

2. Description of Related Art

Generally, in an image forming apparatus that forms a color image by an electrophotographic method, monochrome toner images of Y (yellow), M (magenta), C (cyan), and K (black) are transferred onto an intermediate transfer belt and combined into a composite image (primary transfer), and the composite image is transferred onto a record medium (secondary transfer). At the time of secondary transfer, a transfer bias having a reverse polarity to the toner is applied to a secondary transfer roller in order to form an electric field between the intermediate transfer belt and the secondary transfer roller so that the toner can be moved from the intermediate transfer belt to the record medium. This transfer bias is preferably subjected to constant voltage control which enables favorable transfer regardless of the coverage (ratio of toner in a fixed printed area) of an image to be printed.

As for such constant voltage control, for example, Japanese Patent Laid-Open Publication No. 2008-275946 discloses that while a secondary transfer current is monitored, an applied voltage is controlled so that the secondary transfer voltage will not exceed a predetermined and stored upper limit and will not come below a predetermined and stored lower limit.

Meanwhile, it is necessary to separate the record medium from the intermediate transfer belt immediately after the secondary transfer, and for smooth separation of the record medium, an antistatic needle that removes an electric charge from the record medium is provided immediately after the transfer roller, and a DC voltage is applied to the antistatic needle. Japanese Patent Laid-Open Publication No. 2010-249872 discloses that a value obtained by subtracting a detected antistatic current from a detected secondary transfer current is taken as a transfer contribution current and that a bias voltage applied to the secondary transfer roller is controlled such that the transfer contribution current will be kept within a predetermined range.

Incidentally, for separation of the record medium from the image carrier (intermediate transfer belt) after the transfer and especially for separation of thin paper, it is effective to apply a superimposed voltage of an AC voltage and a DC voltage to the antistatic member. However, when a current flowing through the transfer roller with an AC voltage applied to the antistatic member is measured, a conventional DC measuring device, which instantaneously measures a current, performs erroneous operations because the current flowing through the transfer area during transfer fluctuates in accordance with the period of the AC voltage applied to the antistatic member. Therefore, when the antistatic member to be applied with an AC voltage is employed in an apparatus that is controlled in a manner as described in Japanese Patent Laid-Open Publication No. 2008-275946, a transfer voltage will be set higher gradually, thereby resulting in excess transfer.

SUMMARY OF THE INVENTION

An image forming apparatus according to an aspect of the present invention comprises: an image carrier which carries a toner image; a transfer member which pinches and feeds a record medium in cooperation with the image carrier; a transfer voltage applying device which applies a bias voltage to the transfer member; a voltage controller which performs constant voltage control on the transfer voltage applying device; a transfer contribution current detecting device which detects a transfer contribution current value that contributes to transfer of the toner image from the image carrier to the record medium; an antistatic member which is arranged downstream in a record medium feeding direction from the transfer member and for removing static electricity from the record medium; and an antistatic voltage applying device which applies an AC voltage to the antistatic member, wherein: the transfer contribution current detecting device measures current values during a current detection time, which corresponds to an integral multiple of a period of the AC voltage applied to the antistatic member, and detects the transfer contribution current value from the measured values; and the voltage controller controls the bias voltage applied to the transfer member based on the transfer contribution current value detected by the transfer contribution current detecting device such that the transfer contribution current value will be kept within a predetermined range.

BRIEF DESCRIPTION OF THE DRAWINGS

This and other features of the present invention will be apparent from the following description with reference to the accompanying drawings, in which.

DETAILED DESCRIPTION OF THE PREFERRED EMBODIMENTS

Figure 1:
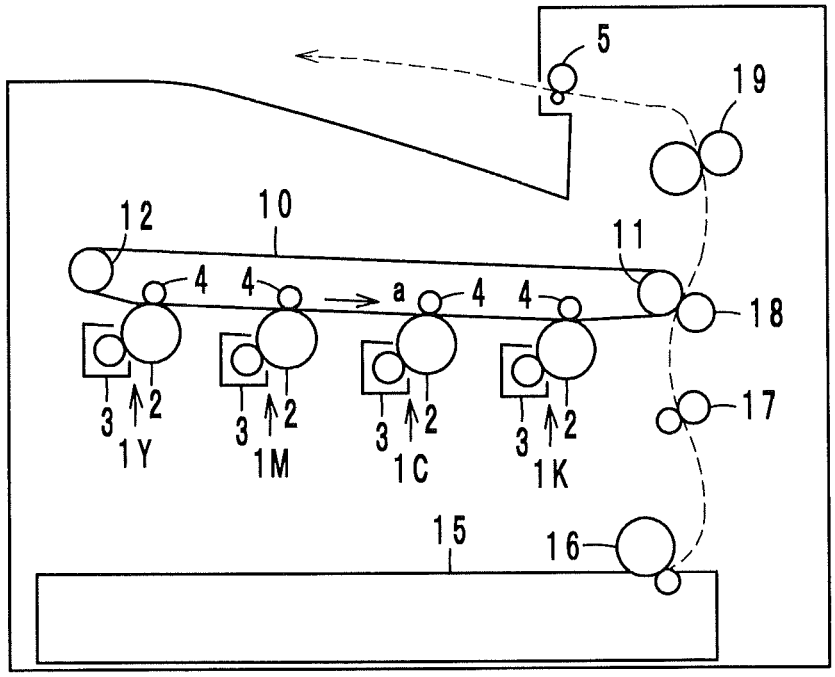
FIG. 1 is a schematic constitutional view of an image forming apparatus.

Hereinafter, embodiments of an image forming apparatus according to the present invention will be described with reference to the accompanying drawings. It should be noted that in the drawings, the same members and parts are provided with common reference numbers, and a repeated description will be omitted.

Overall Structure of Image Forming Apparatus; See FIG. 1

As shown in FIG. 1, the image forming apparatus is configured as a color printer of a tandem type, where image forming units 1Y, 1M, 1C and 1K for forming images of Y (yellow), M (magenta), C (cyan) and K (black), respectively, are arranged in parallel immediately below an intermediate transfer belt 10. Each of the image forming units 1Y, 1M, 1C and 1K has a known configuration where a development unit 3, a primary transfer roller 4 and the like are arranged around a photoreceptor drum 2. The intermediate transfer belt 10 is extended in an endless state between support rollers 11 and 12 and is driven to rotate in a direction shown by arrow a. Toner images formed on the respective photoreceptor drums 2 are primarily transferred sequentially on the intermediate transfer belt 10 to be composed into a color image.

Sheets of a record medium is loaded in a paper feeding tray 15 and fed one by one by a paper feeding roller 16. The fed sheet passes through a nip part between the intermediate transfer belt 10 and a secondary transfer roller 18 via a timing roller pair 17, and meanwhile, the color image is secondarily transferred from the intermediate transfer belt 10 to the sheet by the effect of an electric field generated between the secondary transfer roller 18 and the intermediate transfer belt 10. Subsequently, the sheet is fed to a fixation unit 19 to be subjected to a heating treatment for fixation of toner thereto, and then ejected to the upper surface of the apparatus body through an ejection roller pair 5.

Figure 2:
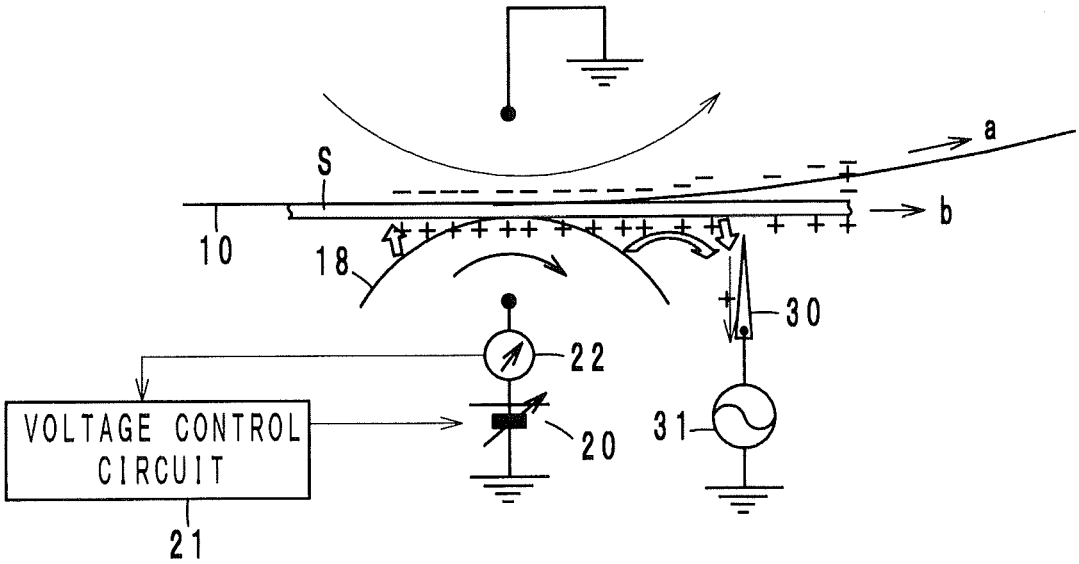
FIG. 2 is an explanatory view schematically showing a configuration of a secondary transfer area in a first embodiment.

Control of Secondary Transfer Current See FIG. 2

In the secondary transfer area, as schematically shown in FIG. 2, because the toner has a negative polarity, a bias DC voltage with a positive polarity is applied between the transfer roller 18 and the intermediate transfer belt 10 so as to generate an electric field therebetween, while the intermediate transfer belt 10 and the secondary transfer roller 18 are pinching and feeding a sheet of a record medium S in a direction shown by arrow b. The toner is transferred onto the sheet S by the effect of the electric field. A DC power supply 20 is connected to the transfer roller 18, and this DC power supply 20 is subjected to constant voltage control by a voltage control circuit 21. Further, a current detector 22, which detects a current flowing from the DC power supply 20 to the transfer roller 18 as a transfer contribution current, is connected to the transfer roller 18, and an output of the current detector 22 is inputted into the voltage control circuit 21. Further, the intermediate transfer belt 10 is grounded via the support roller 11.

Meanwhile, a needle-like antistatic member 30 is arranged downstream in a feeding direction (shown by arrow b) from the transfer roller 18, and an AC voltage is applied from an AC power supply 31 to the antistatic member 30.

For example, the AC voltage applied to the antistatic member 30 is set to have a peak-peak voltage Vpp of 7 kV and a frequency of 1 kHz. The antistatic AC voltage with a frequency of 1 kHz changes with a period of 1 ms. In this case, when a transfer current is detected instantaneously at intervals of 5.55 ms by the current detector 22, the detected transfer current fluctuates with a period of 111 ms. Accordingly, when the DC power supply 20 is subjected to constant voltage control based on the fluctuating detected value, there will cause a problem that the transfer voltage may be heightened to such a high degree to cause excess transfer.

In order to avoid this problem, it is preferable to control the DC power supply 20 based on the amount of an electric charge moved to the sheet of a record medium S such that the secondary transfer current will be kept in a predetermined range between an upper and a lower limit. It is also preferable to detect the transfer current by means of the current detector 22 at intervals of a time longer than the period of the AC voltage applied to the antistatic member 30. Hereinafter, a first embodiment and a second embodiment that perform such voltage control will be described.

Figure 3:
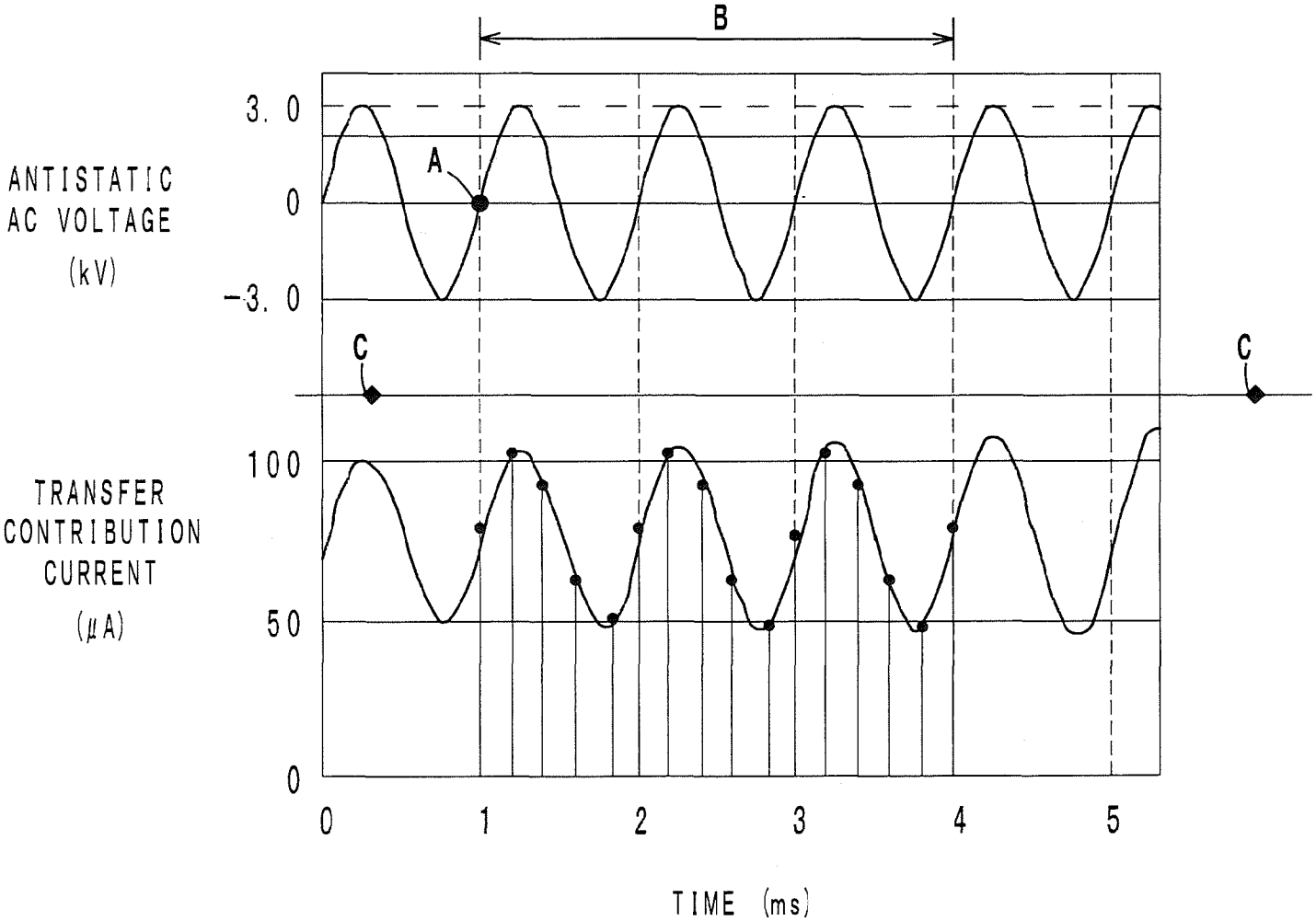
FIG. 3 is a chart diagram showing a transfer contribution current and an antistatic AC voltage at the time of secondary transfer in the first embodiment.
Figure 4:
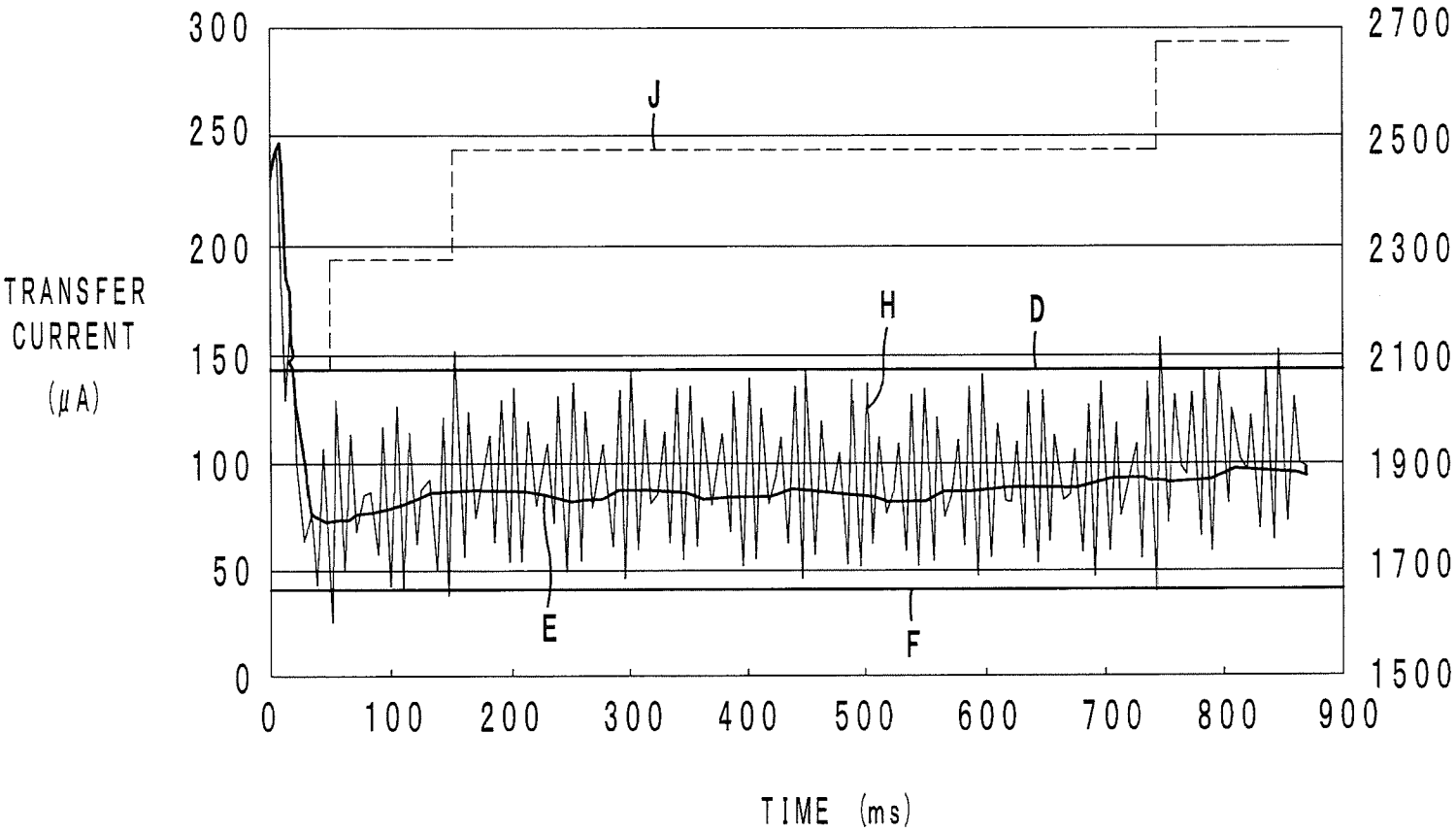
FIG. 4 is a chart diagram showing a transfer contribution current and a transfer voltage at the time of secondary transfer in the first embodiment.

First Embodiment See FIGS. 3 and 4

In the first embodiment, the transfer contribution current is detected at intervals of a time that is an integral multiple of the period of an antistatic AC voltage. The detection is carried out in the following manner. The current detection is started at the time when the antistatic AC voltage is 0V (point A in the upper graph of FIG. 3), and the current is measured repeatedly during a time B corresponding to three periods of the antistatic AC voltage (for 3 ms). Then, the measured current values are averaged, and the average value is fed back as a transfer contribution current value for control of the secondary transfer voltage. The control of the secondary transfer voltage is to control the secondary transfer voltage such that the transfer contribution current will be kept within a predetermined range between an upper limit and a lower limit. Specifically, when the transfer contribution current value exceeds the upper limit, the transfer voltage is lowered by a specified amount, and when the transfer contribution current comes below the lower limit, the transfer voltage is raised by a specified amount. This control is described in detail in Japanese Patent Laid-Open Publication Nos. 2008-275946 and 2010-249872.

In the control of the secondary transfer voltage, a value is fed back to the voltage control circuit 21 at intervals of 5.55 ms (feedback points C in FIG. 3). Therefore, the current detector 22 measures the current during a time corresponding to three periods of the antistatic AC voltage and averages the measured values such that the averaged current value can be fed back in time for next constant voltage control.

Specifically, during the time corresponding to three periods of the antistatic AC voltage, the current is measured 16 times at intervals of 0.2 ms, and if the measured values in the respective times are referred to as $I_1$, $I_2$, $I_3$, . . . $I_{16}$, (see the lower graph of FIG. 3), a value $I_1/2+I_2+I_3+\ldots+I_{14}+I_{15}+I_{16}/2$ is calculated. Then, the calculated value is fed back to the voltage control circuit 21 as the transfer contribution current value. Further, although the total of the measured current values during the time corresponding to three periods of the antistatic AC voltage value is taken as the transfer contribution current value in this embodiment, an arithmetic mean value $(I_1/2+I_2+I_3+\ldots+I_{14}+I_{15}+I_{16}/2)/15$ may be used.

As is described above, the transfer contribution current value calculated from the values measured during a current detection time of 3 ms is fed back to the voltage control circuit 21, and the DC power supply 20 is controlled such that the transfer contribution current value will be kept within a predetermined range (between an upper limit and a lower limit). With this control, as shown by line D in FIG. 4, the transfer voltage is held at almost 2000V, and the problem of the influence of the frequency of the antistatic AC voltage can be solved.

FIG. 4 shows changes in transfer current and transfer voltage while a sheet of a record medium S is passing the secondary transfer area. A line E shows changes in transfer current. Further, a line F shows the lower limit (41 μA) of the current, which necessitates the rising control of the voltage.

In FIG. 4, for the sake of comparison, a line H shows fluctuations in the current that are obtained by instantaneously measuring the transfer current at intervals of 5.55 ms by means of the current detector 22. A line J shows rises of the transfer voltage that are possible results of constant voltage control of the DC power supply 20 based on the fluctuating measured current values, and the rises of the transfer voltage will result in excess transfer.

It is to be noted that, in the first embodiment, although detection of the transfer contribution current starts at the time when the antistatic AC voltage becomes zero (point A of FIG. 3), this is not necessarily required. The current detection time for which the transfer contribution current is measured may be set arbitrarily, as long as the current detection time corresponds to an integral multiple of the period of the antistatic AC voltage and is within such a range that the detected value calculated from the measured current values can be fed back in time for control of the secondary transfer voltage. In the first embodiment, the period of the antistatic AC voltage is equally divided into five, and the current is measured five times at the respective separation points during one period of the antistatic AC voltage. However, the period of the antistatic AC voltage is not necessarily required to be divided into five. Dividing the period into a large number of divisions is preferred in terms of accuracy, but an excessively large number of divisions constitute a burden for control.

Second Embodiment

Figure 5:
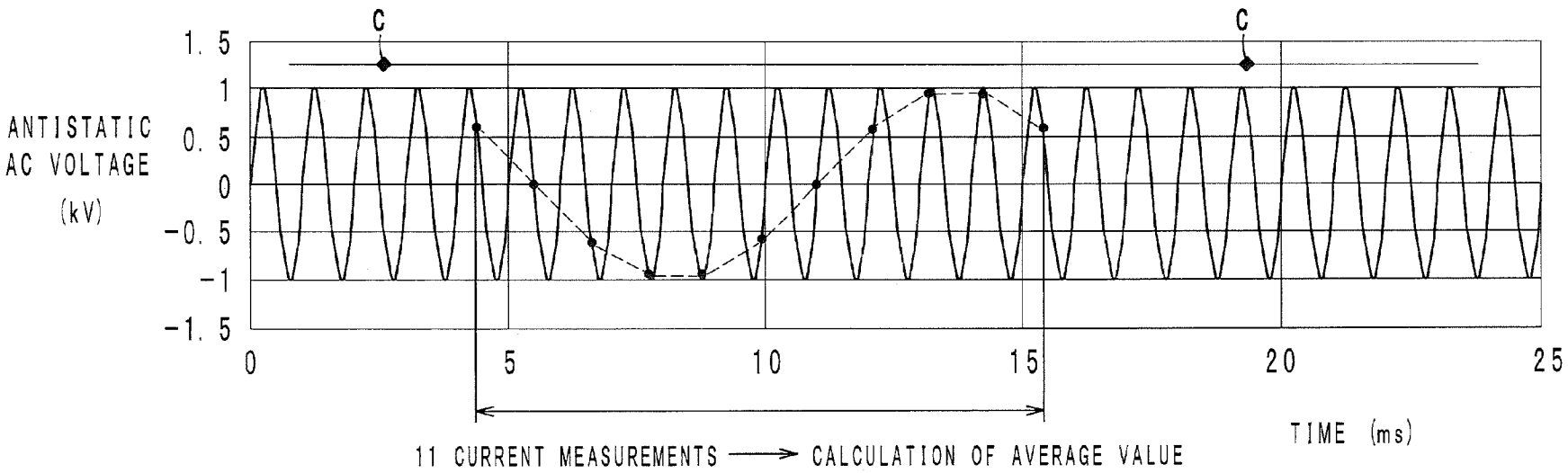
FIG. 5 is a chart diagram showing measurements of a transfer contribution current at the time of secondary transfer in a second embodiment.

See FIG. 5

In the first embodiment, the current is measured at intervals of 0.2 ms. Short intervals among the current measurements cause frequent occurrences of current measurement commands, which leads to frequent interruptions to the control of the apparatus. In some models of image forming apparatuses (especially color printers or copiers with complex control), the frequent interruptions may cause malfunctions of the apparatus. In order to avoid this trouble, in the second embodiment, it is attempted to set the current measurement intervals longer while ensuring effective control of the transfer voltage.

It is sufficient that the control of the secondary transfer voltage is performed at intervals of a time corresponding to a five- to ten-millimeter feed of a sheet of a recording medium S. In the second embodiment, since the antistatic AC voltage has a frequency of 1 kHz (period of 1 ms), the intervals among current measurements are set to 1.1 ms. Then, the current detection time is set to 11 ms, which is ten times as long as the current measurement interval of 1.1 ms.

In the second embodiment, an average value of eleven measured values is fed back to the voltage control circuit 21 as the transfer contribution current value. Specifically, the current is measured eleven times at intervals of 1.1 ms, and if the measured values at the respective times are referred to as $I_1$, $I_2$, $I_3$, . . . $I_{11}$, respectively, a value $I_1/2+I_2+I_3+ \ldots +I_9+I_{10}+I_{11}/2$ is calculated. The calculated value is fed back to the voltage control circuit 21 as the transfer contribution current value. Then, the DC power supply 20 is controlled such that the transfer contribution current value will be kept within the predetermined range between the upper limit and the lower limit. The eleven measured values form a beat with a period of 11 ms, and the transfer contribution current value calculated in the above-described manner almost corresponds to the average value in the period of the beat (see FIG. 5).

By use of an apparatus according to the second embodiment having a process speed of 250 mm/s, an experiment was conducted. In this case, the transfer contribution current value calculated in the above-described manner almost corresponded to an average value of the transfer current that is applied during a 2.75 mm feed of a sheet of a record medium S. The control of the transfer voltage was performed at intervals of 16.65 ms, and the picture quality achieved by the apparatus according to the second embodiment was almost equal to that achieved by an apparatus according to the first embodiment. It is sufficiently effective that the control of the transfer voltage is performed at intervals of a time corresponding to a 15 mm feed of a sheet. Therefore, the control of the transfer current at intervals of 16.65 ms (corresponding to a 4.16 mm feed of a sheet) does not cause any practical problems.

The control method according to the second embodiment is summarized as follows. The period of the antistatic AC voltage, the current measurement interval and the current detection time are set to satisfy the following conditions:

the current measurement interval divided by the period of the antistatic AC voltage equals to K1 (integer)+R1 (remainder after the decimal point);

the period of the antistatic AC voltage divided by R1 equals to K2 (integer); and the current detection time equals to the current measurement interval multiplied by K2.

Then, an average value of measured values obtained during the current detection time is regarded as a transfer contribution current value.

In the second embodiment, the transfer current is measured such that the measured values form a beat period, and an average value during the beat period, that is, an average value of the measured values is calculated and taken as a transfer contribution current value. In the second embodiment, thus, the current detection time can be set longer. Accordingly, the burden on the control of the apparatus can be eased, while the control of the secondary transfer voltage effectively functions.

Other Configurations for Detecting Transfer Contribution Current

Figure 6:
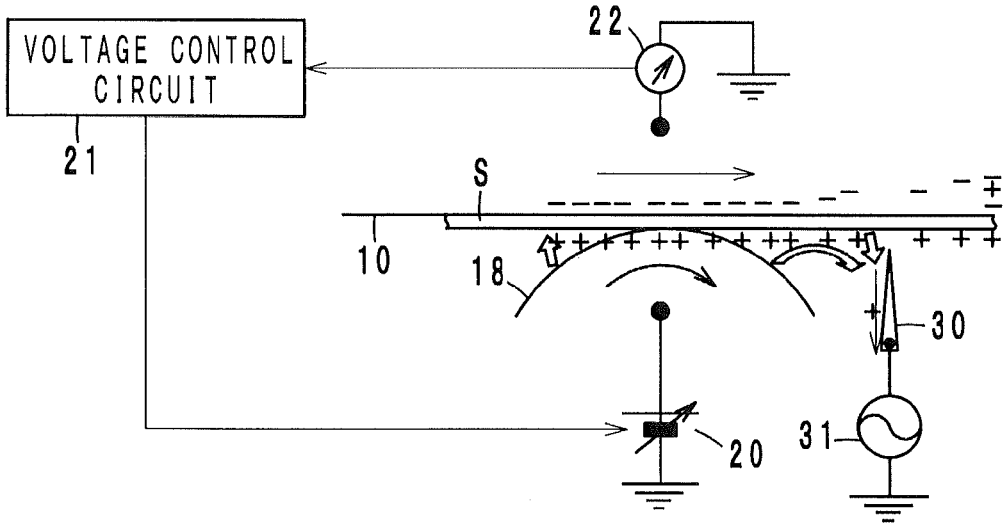
FIG. 6 is an explanatory view showing another example of the transfer contribution current detecting device.
Figure 7:
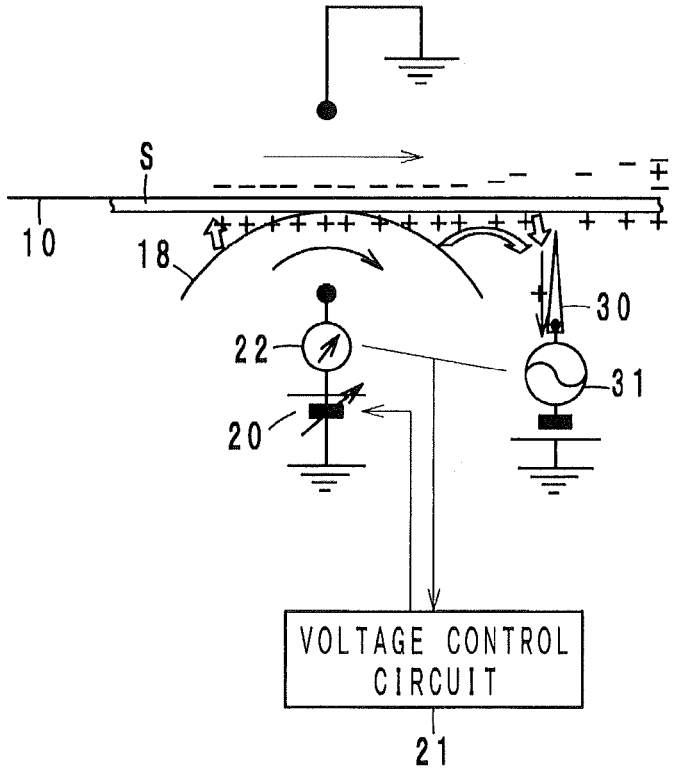
FIG. 7 is an explanatory view showing still another example of the transfer contribution current detecting device.

See FIGS. 6 and 7

Although the configuration shown in FIG. 2 is usable to detect a transfer contribution current, other various configurations may be possible.

FIG. 6 shows a first example of the possible other configurations. In the first example, the current detector 22 is provided in a place where the roller 11 supporting the intermediate transfer belt 10 is grounded. In this case, a current flowing to the support roller 11 is detected as the transfer contribution current, and the voltage control circuit 21 performs constant voltage control on the DC power supply 20 such that the detected current will be kept within a range between an upper limit and a lower limit.

FIG. 7 shows a second example. In the second example, a sum of the current flowing to the transfer roller 18 and the antistatic AC is detected as the transfer contribution current, and this value is fed back for constant voltage control.

Other Embodiments

The overall structure of the image forming apparatus may be arbitrarily designed, and the image forming apparatus is not necessarily a tandem type and may be a four-cycle type. The image carrier from which a toner image is transferred is not necessarily an intermediate transfer belt and may be a photoreceptor drum.

Although the present invention has been described in connection with the preferred embodiments above, it is to be noted that various changes and modifications are possible to those who are skilled in the art. Such changes and modifications are to be understood as being within the scope of the invention.

What is claimed is:

1. An image forming apparatus comprising:

an image carrier which carries a toner image;

a transfer member which pinches and feeds a record medium in cooperation with the image carrier;

a transfer voltage applying device which applies a bias voltage to the transfer member;

a voltage controller which performs constant voltage control on the transfer voltage applying device;

a transfer contribution current detecting device which detects a transfer contribution current value that contributes to transfer of the toner image from the image carrier to the record medium, the transfer contribution current including a current induced by a voltage applied to a transfer Nip where the transfer of the toner image occurs;

an antistatic member which is arranged downstream in a record medium feeding direction from the transfer member and for removing static electricity from the record medium; and an antistatic voltage applying device which applies an AC voltage to the antistatic member, wherein:

the transfer contribution current detecting device measures current values during a current detection time, which corresponds to an integral multiple of a period of the AC voltage applied to the antistatic member, and detects the transfer contribution current value from the measured values; and the voltage controller controls the bias voltage applied to the transfer member based on the transfer contribution current value detected by the transfer contribution current detecting device such that the transfer contribution current value will be kept within a predetermined range.

2. An image forming apparatus comprising:

an image carrier which carries a toner image;

a transfer member which pinches and feeds a record medium in cooperation with the image carrier;

a transfer voltage applying device which applies a bias voltage to the transfer member;

a voltage controller which performs constant voltage control on the transfer voltage applying device;

a transfer contribution current detecting device which detects a transfer contribution current value that contributes to transfer of the toner image from the image carrier to the record medium;

an antistatic member which is arranged downstream in a record medium feeding direction from the transfer member and for removing static electricity from the record medium; and an antistatic voltage applying device which applies an AC voltage to the antistatic member, wherein:

the transfer contribution current detecting device measures current values during a current detection time, which corresponds to an integral multiple of a period of the AC voltage applied to the antistatic member, and detects the transfer contribution current value from the measured values;

the voltage controller controls the bias voltage applied to the transfer member based on the transfer contribution current value detected by the transfer contribution current detecting device such that the transfer contribution current value will be kept within a predetermined range; and the current detection time for which the transfer contribution current detecting device measures current values is shorter than intervals among times of the bias voltage control carried out by the voltage controller.

3. An image forming apparatus comprising:

an image carrier which carries a toner image;

a transfer member which pinches and feeds a record medium in cooperation with the image carrier;

a transfer voltage applying device which applies a bias voltage to the transfer member;

a voltage controller which performs constant voltage control on the transfer voltage applying device;

a transfer contribution current detecting device which detects a transfer contribution current value that contributes to transfer of the toner image from the image carrier to the record medium;

an antistatic member which is arranged downstream in a record medium feeding direction from the transfer member and for removing static electricity from the record medium; and an antistatic voltage applying device which applies an AC voltage to the antistatic member, wherein:

the transfer contribution current detecting device measures current values during a current detection time, which corresponds to an integral multiple of a period of the AC voltage applied to the antistatic member, and detects the transfer contribution current value from the measured values;

the voltage controller controls the bias voltage applied to the transfer member based on the transfer contribution current value detected by the transfer contribution current detecting device such that the transfer contribution current value will be kept within a predetermined range;

the transfer contribution current detecting device measures current values at intervals of a time corresponding to an integral submultiple of the period of the AC voltage applied to the antistatic member; and an average value of the current values measured at the intervals during the current detection time is taken as the transfer contribution current value.

4. The image forming apparatus according to claim 1, wherein the transfer member comprises a secondary transfer roller and a support roller that together form a nip through which an intermediate transfer belt passes and which pinches and feeds the record medium.

* * * * *